US011406137B2

(12) United States Patent
Lee

(10) Patent No.: US 11,406,137 B2
(45) Date of Patent: Aug. 9, 2022

(54) ELECTRONIC CIGARETTE MANUFACTURING DEVICE

(71) Applicant: Jung-soo Lee, Pyeongtaek-si (KR)

(72) Inventor: Jung-soo Lee, Pyeongtaek-si (KR)

( * ) Notice: Subject to any disclaimer, the term of this patent is extended or adjusted under 35 U.S.C. 154(b) by 71 days.

(21) Appl. No.: 17/043,993

(22) PCT Filed: Feb. 7, 2019

(86) PCT No.: PCT/KR2019/001544
§ 371 (c)(1),
(2) Date: Sep. 30, 2020

(87) PCT Pub. No.: WO2019/194405
PCT Pub. Date: Oct. 10, 2019

(65) Prior Publication Data

US 2021/0030053 A1 Feb. 4, 2021

(30) Foreign Application Priority Data

Apr. 6, 2018 (KR) ..... 10-2018-0040195

(51) Int. Cl.
*A24F 40/70* (2020.01)
*A24C 5/01* (2020.01)
(Continued)

(52) U.S. Cl.
CPC ..... *A24F 40/70* (2020.01); *A24C 5/01* (2020.01); *A24C 5/325* (2013.01); *A24C 5/333* (2013.01)

(58) Field of Classification Search
CPC ..... A24C 5/01; A24C 5/325; A24C 5/333; A24C 5/475; A24F 40/70
See application file for complete search history.

(56) References Cited

U.S. PATENT DOCUMENTS 6,021,782 A * 2/2000 Seymour ..... A24C 5/31 118/712
2012/0067360 A1 3/2012 Banerjee et al.
2015/0122273 A1* 5/2015 Mironov ..... A24C 5/00 131/328

FOREIGN PATENT DOCUMENTS

JP 2003-024035 A 1/2003
JP 2006-129806 A 5/2006
(Continued)

*Primary Examiner* — Eric Yaary
(74) *Attorney, Agent, or Firm* — Revolution IP, PLLC

(57) ABSTRACT

The present apparatus relates to an electronic cigarette manufacturing apparatus, and more particularly, to an electronic cigarette manufacturing apparatus with which electronic cigarettes each composed of a plurality of segments can be easily and quickly manufactured without defects and thus productivity improvement and cost reduction can be achieved. The electronic cigarette manufacturing apparatus includes: a supply means configured to accommodate a plurality of segments that form an electronic cigarette and cut and supply the segments in a set length; a delivery means formed on one lower portion of the supply means and configured to deliver the plurality of supplied segments; a transport means including a conveyor configured to divide and transport the plurality of segments delivered from the delivery means so as to prevent defects in an arrangement sequence and a conveyor for integrally transport the plurality of segments; and a finishing means configured to remove spaces between the segments transported through the transport means and cut the segments into specified lengths of the electronic cigarette.

1 Claim, 6 Drawing Sheets

(51) Int. Cl.
*A24C 5/32* (2006.01)
*A24C 5/33* (2006.01)

(56) References Cited

FOREIGN PATENT DOCUMENTS

| | | | |
|---|---|---|---|
| JP | 2006-211951 | A | 8/2006 |
| KR | 10-2017-0058918 | A | 5/2017 |

* cited by examiner

ELECTRONIC CIGARETTE MANUFACTURING DEVICE

TECHNICAL FIELD

The present invention relates to an electronic cigarette manufacturing apparatus, and more particularly, to an electronic cigarette manufacturing apparatus with which an electronic cigarette composed of a plurality of segments can be easily and quickly manufactured without defects and thus productivity improvement and cost reduction can be achieved.

BACKGROUND ART

In general, electronic cigarettes which are manufactured, as alternative products for smoking type cigarettes such as cigarettes, cigars, and pipe cigarettes so that a solution contained in a replaceable cartridge can be inhaled in a steam state, and electronic cigarette manufacturing apparatuses for producing the same have been well known.

Here, recently, next-generation heat-not-burn type electronic cigarettes, which have fourfold structures and are not burn-type (lighting behavior) cigarettes so as to have low tar and contain low contents of harmful substances, have been launched.

Such a heat-non-burn type electronic cigarette is formed by combining segments such as a mono filter, a cooling filter (PLA), a tube, and tobacco.

In addition, in such a heat-but-burn type electronic cigarette, segments such as a mono filter, a cooling filter, a tube, and tobacco should be necessarily combined in order.

However, typical electronic cigarette manufacturing apparatuses have limitations in that even when segments such as a mono filter, a cooling filter, a tube and tobacco are coupled while sequentially transported through a single transport conveyor at time intervals, the segments are continuously supplied, and thus, all the segments cannot be coupled in the 1-2-3-4 or 4-3-2-1 arrangement sequence.

In particular, since a plurality of segments should be respectively supplied through a plurality of hoppers that are formed in parallel, a portion necessarily appears in which the arrangement sequence is formed differently during coupling of the segments even when adjusting a difference (time difference) in rotation time between the hopper located at the most leading side and the hopper located at the most trailing side. Therefore, there were limitations in that defects were caused, workability was not satisfactory due to an excessively long work time, and thus productivity decreased.

DISCLOSURE

Technical Problem

The present invention provides an electronic cigarette manufacturing apparatus which is derived to solve the above limitations and in which when manufacturing an electronic cigarette composed of four segments, the segments are all easily and quickly coupled in an arrangement sequence, and thus, an improvement in productivity is achieved and occurrences of defects are prevented.

Technical Solution

According to an embodiment of the present invention, an electronic cigarette manufacturing apparatus includes: a supply means configured to accommodate a plurality of segments that form an electronic cigarette and cut and supply the segments in a set length; a delivery means formed on one lower portion of the supply means and configured to deliver the plurality of supplied segments; a transport means including a conveyor configured to divide and transport the plurality of segments delivered from the delivery means so as to prevent defects in an arrangement sequence and a conveyor configured to integrally transport the plurality of segments; and a finishing means configured to remove spaces between the segments transported through the transport means and cut the segments into specified lengths of the electronic cigarette.

The supply means may include a first hopper, a second hopper, a third hopper, and a fourth hopper which include a plurality of semicircular attachment grooves formed on an entire circumferential surface thereof so as to respectively accommodate the plurality of segments.

The delivery means may include: a first delivery wheel, a second delivery wheel, a third delivery wheel, and a fourth delivery wheel that deliver the segments; and first arrangement wheels and second arrangement wheels that arrange the transported segments so as to form a set arrangement and deliver the segments.

The conveyor configured to divide and transport the plurality of segments may include a first transport conveyor and a second conveyor, and the conveyor configured to integrally transport the plurality of segments comprises a main conveyor.

The first arrangement wheels may arrange the segments delivered through the first delivery wheel and the second delivery wheel in a sequence of 2-1-2, and the second arrangement wheels may arrange the segments delivered through the third delivery wheel and the fourth delivery wheel in a sequence of 3-4-3.

The first transport conveyor may transport the segments delivered from the first delivery wheel and the second delivery wheel, the second conveyor may transport the segments delivered from the third delivery wheel and the fourth delivery wheel, and the main conveyor may integrate the segments transported from the first conveyor and the second conveyor and transport the segments in a sequence of 2-1-2-3-4-3-2 . . . .

Advantageous Effects

As described above, the present invention has an effect of achieving productivity improvement of electronic cigarettes and preventing occurrence of defects by dividing and transporting a plurality of segments each composed of a mono filter, a cooling filter (PLA), a tube, and tobacco, and then transporting and coupling the segments in sequences of 2-1-2 and 3-4-3 so as to manufacture electronic cigarettes in an arrangement sequence of 1-2-3-4 or 4-3-2-1.

BEST MODE

Hereinafter, preferable embodiments according to the present invention will be described in detail with reference to accompanying drawings.

Here, components having the same function in all the drawings below are referred to by the same reference symbols and repeated description thereon will not be provided, and the terms to be described below are defined considering functions thereof in the present invention, and this clarifies that the terms should be interpreted as an inherent and generally used meaning.

Figure 1:
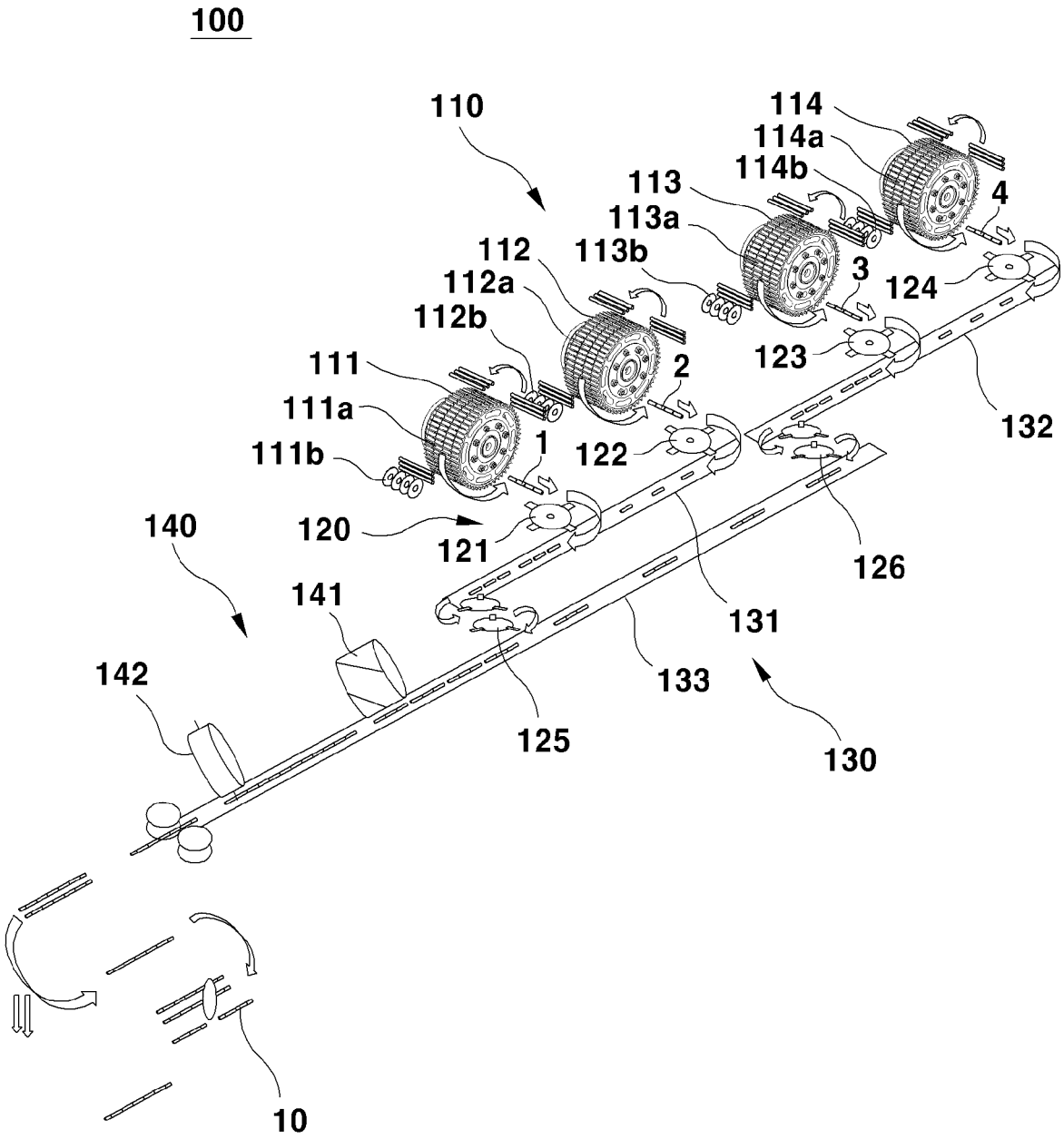
FIG. 1 is a view schematically illustrating the entire configuration of an electronic cigarette manufacturing apparatus according to an preferable embodiment of the present invention.
Figure 2:
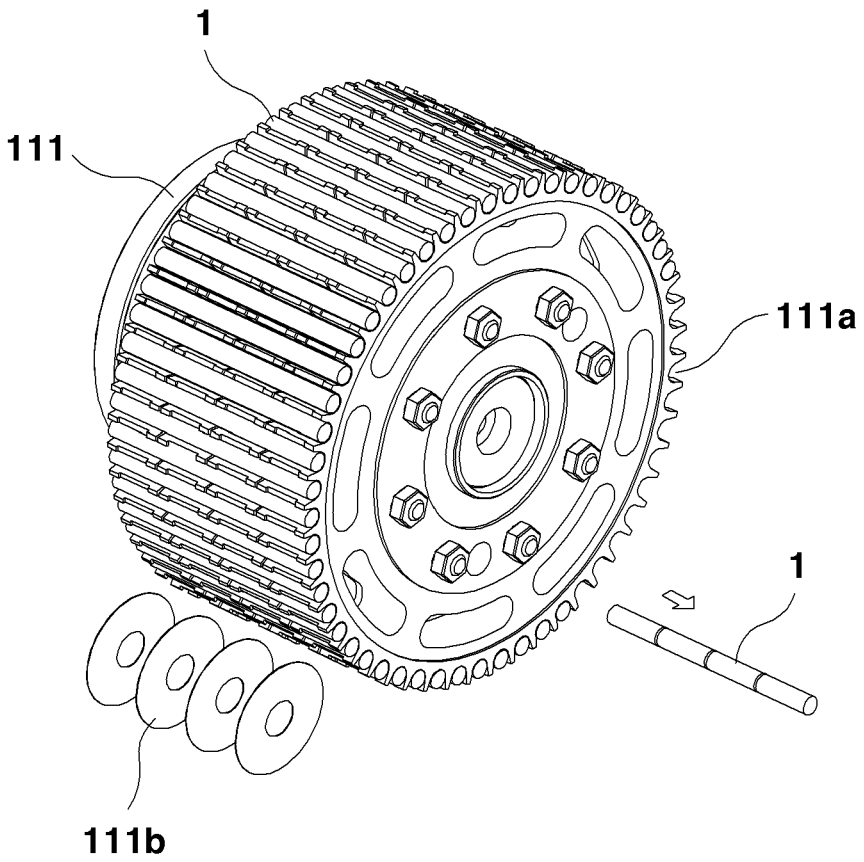
FIG. 2 is an expanded view illustrating a state after accommodating a segment in a first hopper which is one of supplying means according to the present invention.
Figure 3:
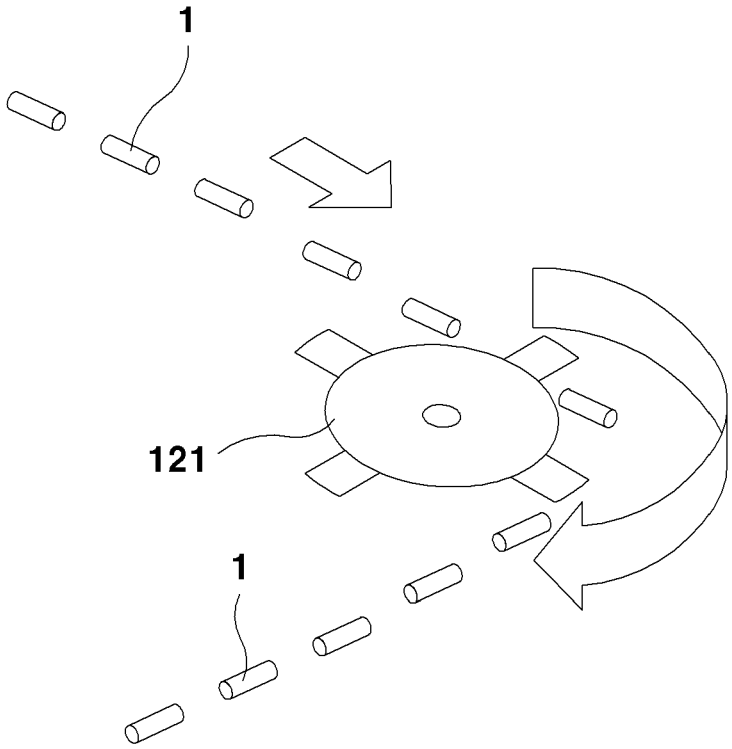
FIG. 3 is a view schematically illustrating a state in which first segments are delivered through a first delivery wheel which is one of delivery means according to the present invention.
Figure 4:
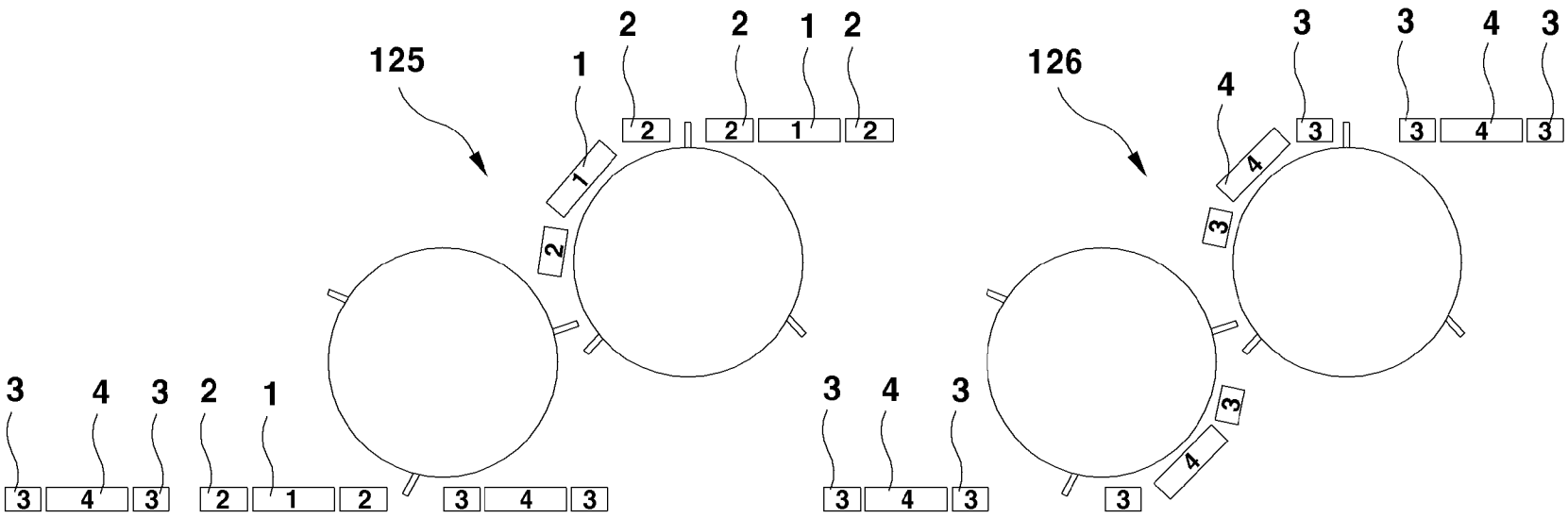
FIG. 4 is a view schematically illustrating a state in which first and second segments and third and fourth segments are arranged and delivered through first arrangement wheels and second arrangement wheels which each of which is one of the delivery means according to the present invention.
Figure 6:
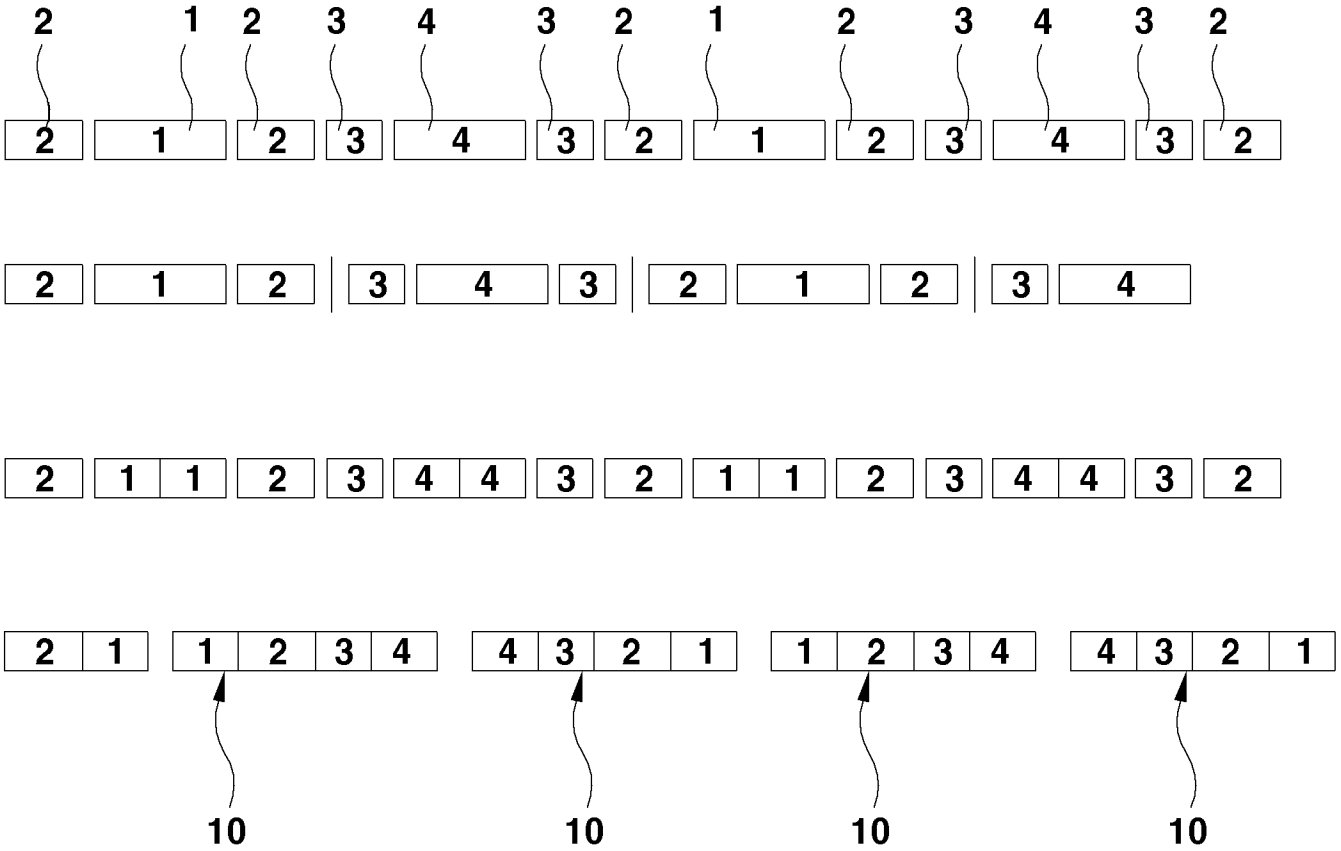
FIG. 6 is a view schematically illustrating an arrangement sequence and electronic cigarette formed during cutting when four segments are divided and continuously delivered through a delivering means and a transporting means.

As illustrated in FIGS. 1 and 6, an electronic cigarette manufacturing apparatus 100 according to the present invention is roughly composed of a supply means 110, a delivery means 120, a transport means 130, and a finishing means 140.

The supply means 110 accommodates a plurality of segments 1, 2, 3 and 4 which form an electronic cigarette 10 and cuts the segments into predetermined lengths and supplies the segments.

The supply means 110 is composed of a first hopper, a second hopper 112, a third hopper 113, and a fourth hopper 114 which respectively have semi-circular attachment grooves 111*a*, 112*a*, 113*a* and 114*a* which are formed on the entire circumferential surface so as to respectively accommodate a plurality of segments 1, 2, 3 and 4, that is, a first segment 1, a second segment 2, a third segment 3, and a fourth segment 4 which have thin cylindrical shapes, to cut the segments into predetermined lengths and to supply the segments.

Here, the first segment 1, the second segment 2, the third segment 3, and the fourth segment 4 are each composed of a mono filter, a cooling filter (PLA), a tube, and tobacco.

In addition, a first cutter 111*b*, a second cutter 112*b*, a third cutter 113*b*, and a fourth cutter 114*b* for cutting, into predetermined lengths, the first segment 1, the second segment 2, the third segment 3, and the fourth segment 4 which are accommodated in the attachment grooves 111*a*, 112*a*, 113*a* and 114*a* on one side of the first hopper 111, the second hopper 112, the third hopper 113, and the fourth hopper 114.

In addition, the first hopper 111, the second hopper 112, the third hopper 113, and the fourth hopper 114 are configured to rotate by a plurality of servomotors (not shown).

Here, the servomotors are configured to be interlocked with a computer (not shown) including a pre-designed program (collection of instructions sequentially prepared so as to execute a computer) for manufacturing of the electronic cigarettes and a central processing unit (key apparatus of a computer system for controlling processes such as interpretation of instructions, calculation and comparison of data).

Such a computer control system is generally used over the entire industries with a program changed according to needs, and thus detailed description thereon will be omitted.

Accordingly, when the servomotors are rotationally driven by using a separate operation switch (not shown), the first hopper 111, the second hopper 112, the third hopper 113 and the fourth hopper 114 are rotationally driven interlocked with the servomotors.

At this point, the first segment 1, the second segment 2, the third segment 3 and the fourth segment 4 respectively accommodated in the attachment grooves 111*a*, 112*a*, 113*a* and 114*a* are cut into predetermined lengths by the first cutter 111*b*, the second cutter 112*b*, the third cutter 113*b*, and the fourth cutter 114*b* according to the computer program.

For example, the first segment 1 and the fourth segment 4 are set so as to be cut lengthily by approximately two times the lengths of the second segment 2 and the third segment 3. In addition, the first segment 1, the second segment 2, the third segment 3, and the fourth segment 4 which are cut into predetermined lengths are supplied to downward directions.

The delivery means 120 functions to deliver the segments 1, 2, 3 and 4 which are formed on one lower side of the supply means 110 and supplied.

The delivery means 120 is composed of a first delivery wheel 121, a second wheel 121, a third wheel 123, and a fourth wheel 4 that respectively deliver the first segment 1, the second segment 2, the third segment 3, and the fourth segment 4 to the transport means 130, and is composed of first arrangement wheels 125 that deliver the first segment 1 and the second segment 2 arranged in the 2-1-2 or 1-2-1 sequence to the transport means 130, and second arrangement wheels 126 that deliver the third segment 3 and fourth segment 4 arranged in the 3-4-3 or 4-3-4 sequence to the transport means 130.

Here, the first delivery wheel 121, the second delivery wheel 122, the third delivery wheel 123, and the fourth wheel 124 are formed on one lower side of the first hopper 111, the second hopper 112, and the third hopper 113 and the fourth hopper 114 that constitute the supply means 110, the first arrangement wheels 125 are formed on one front side of the first delivery wheel 121, and the second arrangement wheels 126 are formed on one front side of the third delivery wheel 123.

In addition, the first delivery wheel 121, the second delivery wheel 122, the third delivery wheel 123, and the fourth delivery wheel 124 are configured to rotationally driven by the servomotors (not shown) and deliver the first segment 1, the second segment 2, the third segment 3, and the fourth segment 4 to the transport means 130 one by one by a control operation of the computer (not shown) including a pre-designed program when operating the separate switch (not shown).

In addition, the first arrangement wheels 125 arrange the first segment land the second segment 2 in the 2-1-2 or 1-2-1 sequence and transport the segments to the transport means 130, and the second arrangement wheels 126 arrange the third segment 3 and the fourth segment 4 in the 3-4-3 or 4-3-4 sequence and deliver the segments to the transport means.

The transport means 130 is composed of a conveyor that divides and transports the plurality of segments 1, 2, 3 and 4 delivered from the delivery means 120 so as to prevent a defective arrangement sequence, and a conveyor that integrally transports the segments.

That is, the transport means 130 is composed of a first transport conveyor 131 formed on one side of the first delivery wheel 121 and the second delivery wheel 122, a second conveyor 132 formed on one side of the third delivery wheel 123 and the fourth delivery wheel 124, and a main conveyor 133 formed on one side of the first arrangement wheels 126 and the second arrangement wheel 126*s*.

In addition, the first transport conveyor 131 transport the first segment 1 and the second segment 2 which are delivered from the first delivery wheel 121 and the second delivery wheel 122, and the second conveyor 132 transport the third segment 3 and the fourth segment which are delivered from the third delivery wheel 123 and the fourth delivery wheels 124.

In addition, the main conveyor 133 integrates the first segment 1, the second segment 2, the third segment 3, and the fourth segment 4 which are transported from the first conveyor 131 and the second conveyor 132 and arranged and transported by the first arrangement wheels 125 and the second arrangement wheels 126 in the 2-1-2 or 3-4-3 sequence, and transports the segments in the 2-1-2-3-4-3-2-1-2-3-4-3-2 . . . .

The reason for integrating and transporting the segments as such is because when the first segment 1, the second segment, the third segment, and the fourth segment are continuously moved through one conveyor, there is limitations in that not only the arrangement sequences of the first segment 1, the second segment 2, the third segment 3, and the fourth segment 4 are not matched, but also defects are caused.

Figure 5:
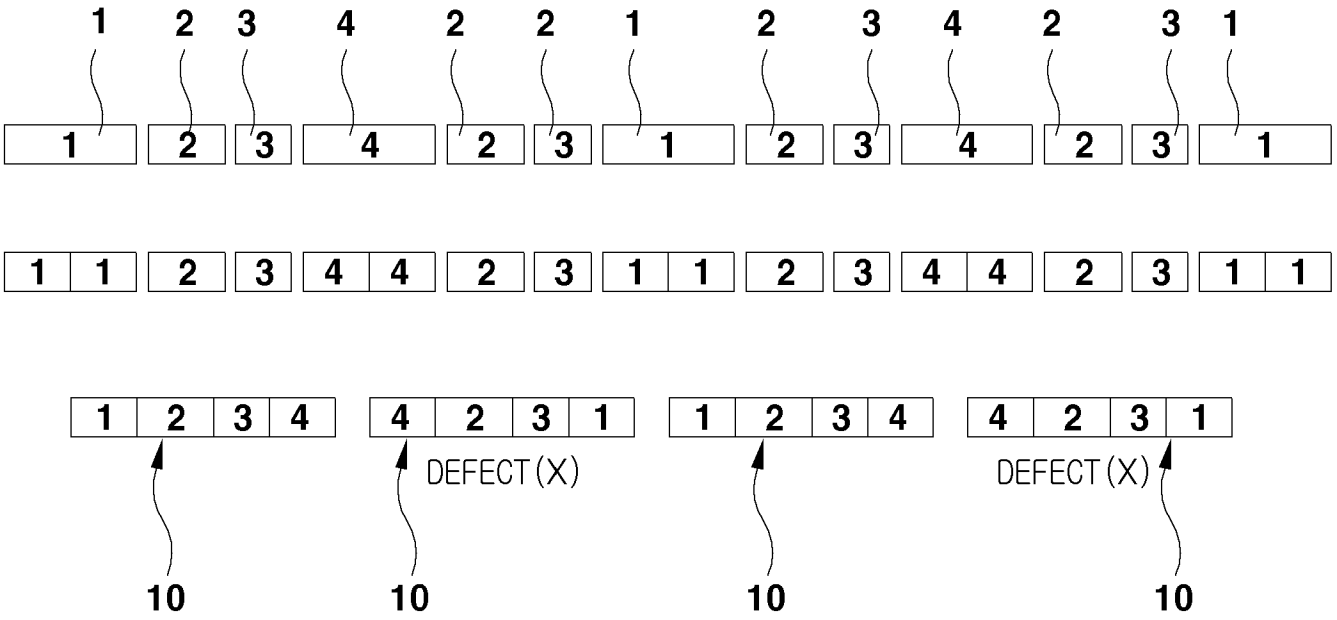
FIG. 5 is a view schematically illustrating an arrangement sequence and electronic cigarettes formed during cutting when four segments are continuously transported through one conveyor.

More specifically describing this, when the first segment 1, the second segment, the third segment, and the fourth segment are continuously moved through one conveyor, as described in FIG. 5, the first segment 1, the second segment 2, the third segment 3, the fourth segment 4, the second segment 2, the third segment 3, the first segment 1, and the second segment 2, the third segment 3, the fourth segment 4, the second segment 2, and the third segment 3, the first segment 1 . . . are continuously moved in this order.

That is, the number of segments that constitute the electronic cigarette 10 are four, and are discharged in parallel with time differences by the first hopper 111, the second hopper 112, the third hopper 113 and the fourth hopper 114, and therefore even when the time differences are adjusted, the first segment 1, the second segment 2, the third segment, and the fourth segment are not always discharged in the 1-2-3-4 arrangement sequence, but the first segment 1, the second segment 2, the third segment, and the fourth segment are discharged in the sequence of 1-2-3-4-2-3-1-2-3-4-2-3-1 . . . .

At this point, when completing the electronic cigarette 10, the first segment 1 and the fourth segment 4 are continuously supplied even when the first segment 1 and the fourth segment 4 are formed in the length of two times the lengths of the first segment 1 and the fourth segment 4, and therefore the electronic cigarettes 10 are arranged, when cut in the standard lengths, in the sequences of 1-2-3-4 (good products), 4-2-3-1 (defective products), 1-2-3-4 (good products), and 4-2-3-1 (defective products) and a great amount of defective products are caused.

As such, in the present invention, the sequence of the segments 1, 2, 3 and 4 respectively supplied through the plurality of hoppers formed in parallel is arranged while dividing and transport the segments through the transport means 130 formed in plurality, and the segments are integrally transported, and thus, the continuously supplied segments may all be arranged in the sequences of 1-2-3-4 or 4-3-2-1.

Accordingly, the occurrence of a defective arrangement sequence may be prevented, and workability and productivity may be achieved by smooth work.

The finishing means 140 removes spaces between the plurality of segments 1, 2, 3 and 4 transported through the transport means 130 and cuts the segments into the specified length of the electronic cigarette 10.

That is, the finishing means 140 is composed of a spacer drum 141 formed on one front side of the main conveyor 133 and a knife 142 formed on one front side of the spacer drum 141.

In addition, the spacer drum 141 removes spaces (gaps) between the segments 1, 2, 3 and 4 while passing the first segment 1, the second segment 2, the third segment 3 and the fourth segment 4, which continuously move through the main conveyor 133, in the arranged sequence, and thus, the spacer drum functions to assist the segments 1, 2, 3 and 4 to be firmly enclosed by a winding paper (not shown) supplied from a separate winding paper supplier (not shown) and to form one body.

Here, the winding paper supplier is generally provided to cigarette manufacturing apparatuses, and thus detailed description thereon will be omitted.

In addition, the knife 142 cuts the first segment 1, the second segment 2, the third segment 3, and the fourth segment 4, which integrally move, into a set length of the electronic cigarette 10.

That is, the knife 142 is formed in a disk shape interlocked with the rotary movement of the motor (not shown) which is a power source and a gear (not shown), and a plurality of cutting blades 142*a* for cutting are formed on the outer circumferential surface of the knife.

The knife 142 having such a configuration adjusts the rotary speed of the motor to be quick or slow and thus adjusts the cut length.

For example, when the rotary speed of the motor is adjusted to be high, the cut length decreases, and when the rotary speed of the motor is adjusted to be low, the cut length increases.

Here, when the segments are cut in the set length of the electronic cigarette using the knife 142, intermediate portions of the first segment 1 and the fourth segment 4 that are formed to be two times longer than the lengths of the second segment 2 and the third segment 3 among the segments 1, 2, 3 and 4 moving in the sequence of 2-1-2, 3-4-3, 2-1-2, 3-4-3, 2- . . . .

That is, when the intermediate portions of the first segment 1 and the fourth segment 4 among the segments 1, 2, 3 and 4 moving in the sequence of 2-1-2, 3-4-3, 2-1-2, 3-4-3, 2- . . . , electronic cigarettes matching the arrangement sequence of 1-2-3-4 and 4-3-2-1 may be continuously manufactured.

Meanwhile, it is desirable that a defect discharge drum (not shown), which discharges defects of the electronic cigarettes 10 that are cut in the arrangement sequence of 1-2-3-4 or 4-3-2-1 and transported through the main conveyor 133, and a good product discharge drum (not shown) that discharges good products are formed on one front side of the knife 142.

The electronic cigarettes 10 discharged through the good product discharge drum are packaged by a packaging machine (not shown) and provided as finished products.

The operation state of the present invention configured as described above will be described as the following.

First, when manufacturing electronic cigarettes using an electronic cigarette manufacturing apparatus 100 according to the present invention, a plurality of segments 1, 2, 3 and 4 that form the electronic cigarettes 10 are put in so as to be accommodated in respective attachment grooves 111*a*, 112*a*, 113*a* and 114*a* of a first hopper 111, a second hopper 112, a third hopper 113, and a fourth hopper 114, which are supply means 110.

In addition, the first hopper 111, the second hopper 112, the third hopper 113 and the fourth hopper 114 are rotationally driven.

At this point, the first segment 1, the second segment 2, the third segment 3 and the fourth segment 4 respectively accommodated in the attachment grooves 111*a*, 112*a*, 113*a* and 114*a* are cut into predetermined lengths by a first cutter 111*b*, a second cutter 112*b*, a third cutter 113*b*, and a fourth cutter 114*b*.

Here, the first segment 1 and the fourth segment 4 are set so as to be cut in a length approximately two times the lengths of the second segment 2 and the third segment 3.

Subsequently, the first segment 1, the second segment 2, the third segment 3, and the fourth segment 4 which are cut into predetermined lengths are supplied in downward directions.

Next, the first segment 1, the second segment 2, the third segment 3, and the fourth segment 4 which are supplied in downward directions are continuously moved to a first conveyor 141 and a second conveyor 142 by a first delivery wheel 121, a second delivery wheel 122, a third delivery wheel 123, and a fourth delivery wheel 124.

Here, the first segment 1 and the second segment 2 are continuously moved to the first conveyor 141 and the third segment 3 and the fourth segment 4 are continuously moved to the second conveyor 142.

Next, the first segment 1 and the second segment 2 that are continuously moved to the first conveyor 141 are arranged in the sequence of 2-1-2 by the first arrangement wheels 125 and delivered to the main conveyor 133, and the third segment 3 and the fourth segment 4, which are continuously moved to the second conveyor 142, are arranged in the sequence of 3-4-3 by the second arrangement wheels 126 and delivered to the main conveyor 133.

At this point, the first arrangement wheels 125 and the second arrangement wheels 126 respectively move the first segment 1, the second segment 2, and the third segment 3 and the fourth segment 4 while operating at different time differences by a preprogrammed control operation.

For example, the first segment 1 and the second segment 2 that move through the first conveyor 141 are slowly arranged so as to move somewhat slowly, and the third segment 3 and the fourth segment 4 that move through the second conveyor 142 are speedily moved, and may thus easily adjust an arrangement sequence when moving the segments to the main conveyor 133.

Subsequently, the first segment 1, the second segment 2, the third segment 3 and the fourth segment 4 that are moved in the sequence of 2-1-2 and 3-4-3 to the main conveyor 133 are brought into close contact with each other in the sequence of 2-1-2-3-4-3 . . . through a spacer drum 141 constituting a finishing means 140, and moved by being enclosed by a winding paper (outer skin) so as to form one body.

That is, the first segment 1 and the second segment 2 that move in the sequence of 2-1-2 and the third segment 3 and the fourth segment 4 that move in the sequence of 3-4-3 are brought into close contact with each other while passing through the spacer drum 141, and thus, spaces (gaps) between the segments 1, 2, 3 and 4 are removed and a firm state is formed.

Next, the segments 1, 2, 3 and 4 that are enclosed by the winding paper and integrally move are cut into electronic cigarettes 10 having lengths set by the knife 142 and then only good products are transported to a packaging machine (not shown) and packaged.

Here, the first segment 1 and the fourth segment 4 are cut during cutting work of the first segment 1, the second segment 2, the third segment 3, and the fourth segment 4 that are arranged in the sequence of 2-1-2-3-4-3 . . . and moved.

That is, the lengths of the first segment 1 and the fourth segment 4 are cut and supplied in the length of two times the lengths of the first segment 1 and the fourth segment 4 when finishing the electronic cigarette 10, and therefore even when an intermediate portion of the first segment 1 or the fourth segment 4 is cut, the electronic cigarettes 10 having the standard lengths may be continuously manufactured corresponding to arrangement sequences.

The present invention described so far is not limited to the abovementioned embodiments and the accompanying drawings, it would be obvious to those skilled in the art that various replacements, modifications, and changes can be made therein without departing from the spirit and scope of the following claims.

INDUSTRIAL APPLICABILITY

Thus, the present invention may achieve an improvement in productivity of electronic cigarettes and prevent occurrences of defects by coupling several segments constituting the electronic cigarette by repeating the above-described operations.

The invention claimed is:

1. An electronic cigarette manufacturing apparatus comprising:

a supply means configured to accommodate a plurality of segments configured to form an electronic cigarette and cut and supply the segments in a set length, wherein the supply means comprises a first hopper, a second hopper, a third hopper, and a fourth hopper which comprise a plurality of semicircular attachment grooves formed on an entire circumferential surface thereof so as to respectively accommodate the plurality of segments;

a delivery means formed on one lower portion of the supply means and configured to deliver the plurality of supplied segments, wherein the delivery means comprises:

a first delivery wheel, a second delivery wheel, a third delivery wheel, and a fourth delivery wheel configured to respectively deliver the segments; and first arrangement wheels and second arrangement wheels configured to arrange the transported segments so as to form a set arrangement and deliver the segments;

a transport means comprising a transport conveyor having a first and a second transport conveyors, the transport conveyor configured to divide and transport the plurality of segments delivered from the delivery means so as to prevent defects in an arrangement sequence and a main conveyor configured to integrally transport the plurality of segments; and a finishing means configured to remove spaces between the segments transported through the transport means and cut the segments into specified lengths of the electronic cigarette, wherein:

the first arrangement wheels arrange the segments delivered through the first delivery wheel and the second delivery wheel in a sequence of 2-1-2; and the second arrangement wheels arrange the segments delivered through the third delivery wheel and the fourth delivery wheel in a sequence of 3-4-3, wherein:

the first transport conveyor transports the segments delivered from the first delivery wheel and the second delivery wheel;

the second conveyor transports the segments delivered from the third delivery wheel and the fourth delivery wheel; and the main conveyor integrates the segments transported from the first conveyor and the second conveyor and transports the segments in a sequence of 2-1-2, 3-4-3, 2- . . . through the first arrangement wheels and the second arrangement wheels.

* * * * *